US006398599B1

(12) United States Patent
Irikura et al.

(10) Patent No.: US 6,398,599 B1
(45) Date of Patent: Jun. 4, 2002

(54) MALE CONTACT HAVING CONTACT ENTANGLING PREVENTION MEANS

(75) Inventors: Kentaro Irikura, Saitama; Hiroshi Kitamura, Kanagawa, both of (JP)

(73) Assignee: Tyco Electronics. Amp, K.K. (JP)

( * ) Notice: Subject to any disclaimer, the term of this patent is extended or adjusted under 35 U.S.C. 154(b) by 0 days.

(21) Appl. No.: 09/930,332

(22) Filed: Aug. 15, 2001

(30) Foreign Application Priority Data

Aug. 25, 2000 (JP) ..... 2000-255309

(51) Int. Cl.[7] ..... H01R 9/24; H01R 13/02; H01R 13/52

(52) U.S. Cl. ..... 439/884; 439/271

(58) Field of Search ..... 439/271, 587, 439/589, 595, 66, 597, 852, 866, 867, 877, 825, 884, 888, 891

(56) References Cited

U.S. PATENT DOCUMENTS

| | | | | | |
|---|---|---|---|---|---|
| 4,045,868 | A | * | 9/1977 | Ammon et al. | 29/845 |
| 4,998,896 | A | * | 3/1991 | Lundergan | 439/274 |
| 5,211,589 | A | * | 5/1993 | McCardell | 439/176 |
| 5,462,459 | A | * | 10/1995 | Childs | 439/843 |
| 5,681,190 | A | * | 10/1997 | Childs | 439/842 |

* cited by examiner

*Primary Examiner*—Brian Sircus
*Assistant Examiner*—Chandrika Prasad

(57) ABSTRACT

A male contact is provided having a main body. A contact section extends forward from the main body and a termination portion extends rearward from the main body.

The top wall of a main body is formed of two top plates which are superimposed on each other. Walls extend from the inside top plate in the vicinity of the rear end of the main body and in the vicinity of the front near the engaging hole.

5 Claims, 5 Drawing Sheets

MALE CONTACT HAVING CONTACT ENTANGLING PREVENTION MEANS

FIELD OF THE INVENTION

The present invention relates to a male contact for an electrical connector.

BACKGROUND

Male contacts having a contact portion disposed at a front end, and a wire termination section at a rear end are known in the art. In such male contacts, a box shaped part having a top wall is formed by raising both sides of a flat plate and further bending both sides of this flat plate. An intermediate part is generally located between the contact portion and the wire termination section. A stabilizer extends from a portion of the contact to prevent it from rotating inside the housing, and an engaging hole receives a housing lance that is used to secure the male contact into the housing.

For example, Japanese Patent Application No. H9-82396 discloses connector which is equipped with such a male contact, capable of detecting partial-insertion of the contact, and having high retention strength when the contact is fully inserted.

A plurality of male contacts are generally manufactured, and are inserted into such a connector housing after electrical wires have been terminated to the respective termination sections. During this process, the contact portions of some male contacts may be inadvertantly inserted into the termination sections or box shaped parts of others before assembly into the connector housing. When such inadvertent insertion occurs, it is difficult to separate the contacts from each other. During separation, the contact portion is usually bent or otherwise damaged.

In the above-mentioned Japanese Patent Application No. H9-82396, a wall that prevents the entry of male contact parts is formed in the termination section. However, this wall that prevents the entry of male contact portions is formed only to cover a portion of the termination section that engages a retainer. Entry of the contact portions of other male contacts is therefore not completely prevented.

SUMMARY

In light of these problems, an object of the present invention is to provide a male contact in which contact sections are prevented from entering the termination sections of other male contacts. A male contact is therefore provided having a termination section extending rearward from a main body and a contact portion extending forward from a main body. The contact has a bottom wall, a pair of side walls, and a top wall forming the main body. The top wall further is formed of two plates which are superimposed over each other. Front and back walls that extend downward from the top plates to block forward and rearward openings in the main body.

BRIEF DESCRIPTION OF THE DRAWINGS

The invention will now be described by way of example with reference to the accompanying figures of which.

DETAILED DESCRIPTION OF THE PREFERRED EMBODIMENT

Figure 1:
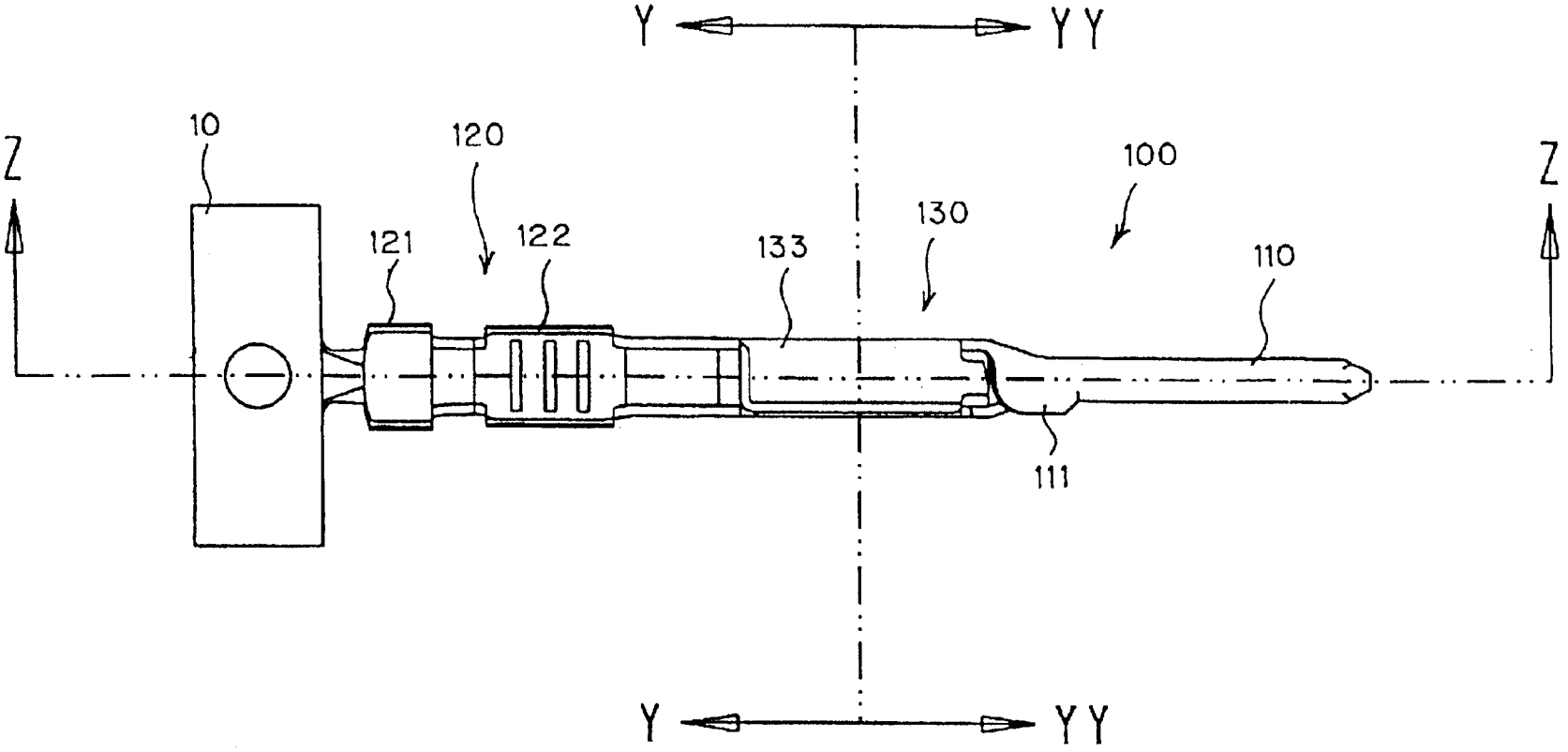
FIG. 1 is a plan view of a male contact of the present invention.
Figure 2:
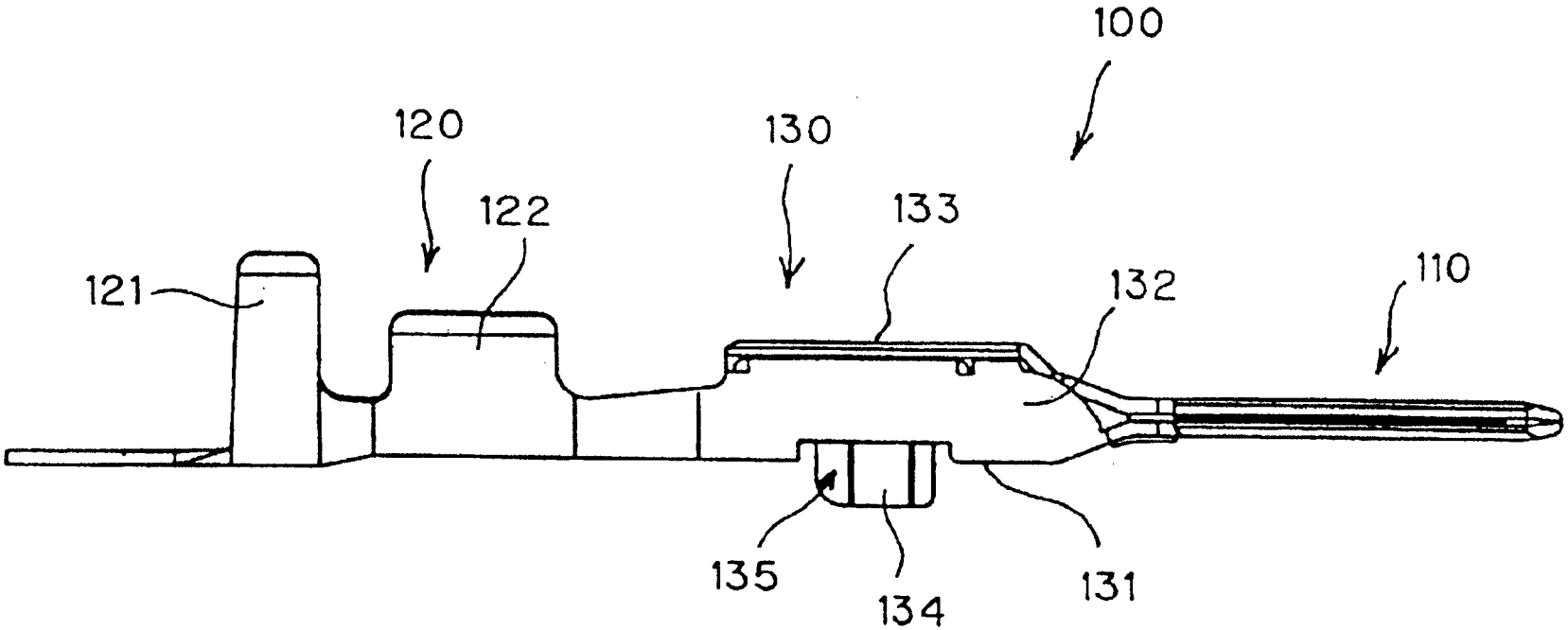
FIG. 2 is a front view of the male contact of the present invention.
Figure 3:
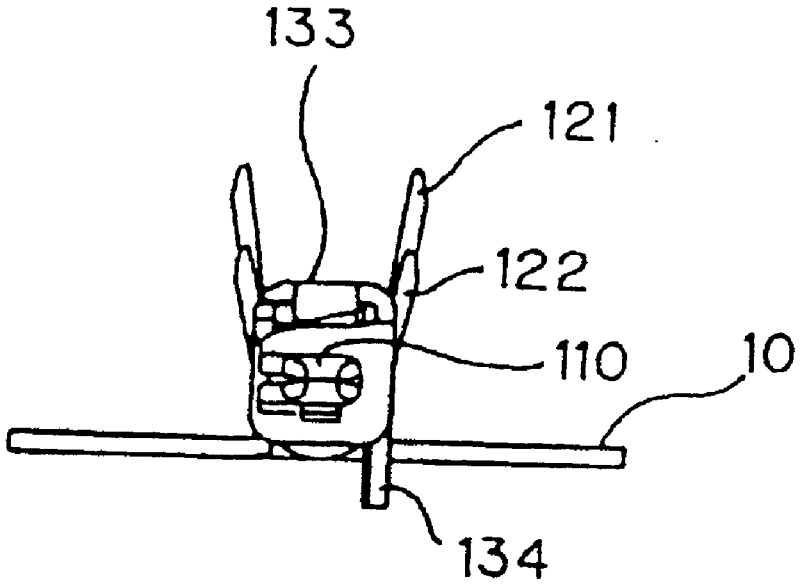
FIG. 3 is a right-side view of the male contact of the present invention.
Figure 4:
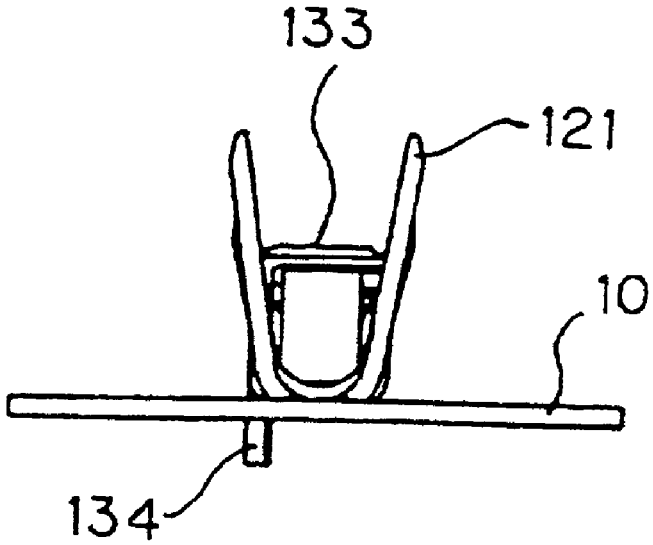
FIG. 4 is a left-side view of a male contact of the present invention.

The male contact 100 is shown with a carrier 10 that is required for manufacturing. This carrier 10 is removed after the contact is formed and prior to termination.

A contact portion 110 being bent from a blank is located at a front end and has a thickness that is approximately twice the thickness of the blank. This contact portion 10 establishes electrical contact with a female contact (not shown in the figures). A stabilizing section 111 protrudes in the lateral direction near the root portion of the contact portion 110. This stabilizing section 111 is used to position the male contact 100 in the housing by entering a groove in the housing.

An wire termination section 120 to which an electrical wire (not shown in the figures) is connected is formed at the rear end of the male contact 100. This wire termination section 120 is equipped with an insulation barrel 121 which is used to grip the insulated portion of the electrical wire, and a wire barrel 122 for receiving of electrical wire. The termination section 120 is crimped into the electrical wire by known methods.

A main body 130 is located between the contact section 110 and termination portion 120. The main body 130 is formed by a bottom wall 131, side walls 132 extending up from both sides of the bottom wall 131, and a top wall 133. The top wall 133 is constructed from two superimposed top plates 133*a* and 133*b*, as is shown in FIG. 5.

A stabilizer 134 which is cut and bent from the bottom wall 131. This stabilizer 134 stabilizes the male contact 100 in the housing by entering a groove in the housing when inserted therein. Furthermore, the stabilizer 134 acts as a key so that the male contact 100 can be inserted into the housing only when it is correctly oriented with respect to the housing.

The bottom wall 131 has an engaging hole 135 which is formed by the material removed for the stabilizer 134. This engaging hole 135 engages a housing lance to prevent the male contact from pulling out of the housing.

Figure 5:
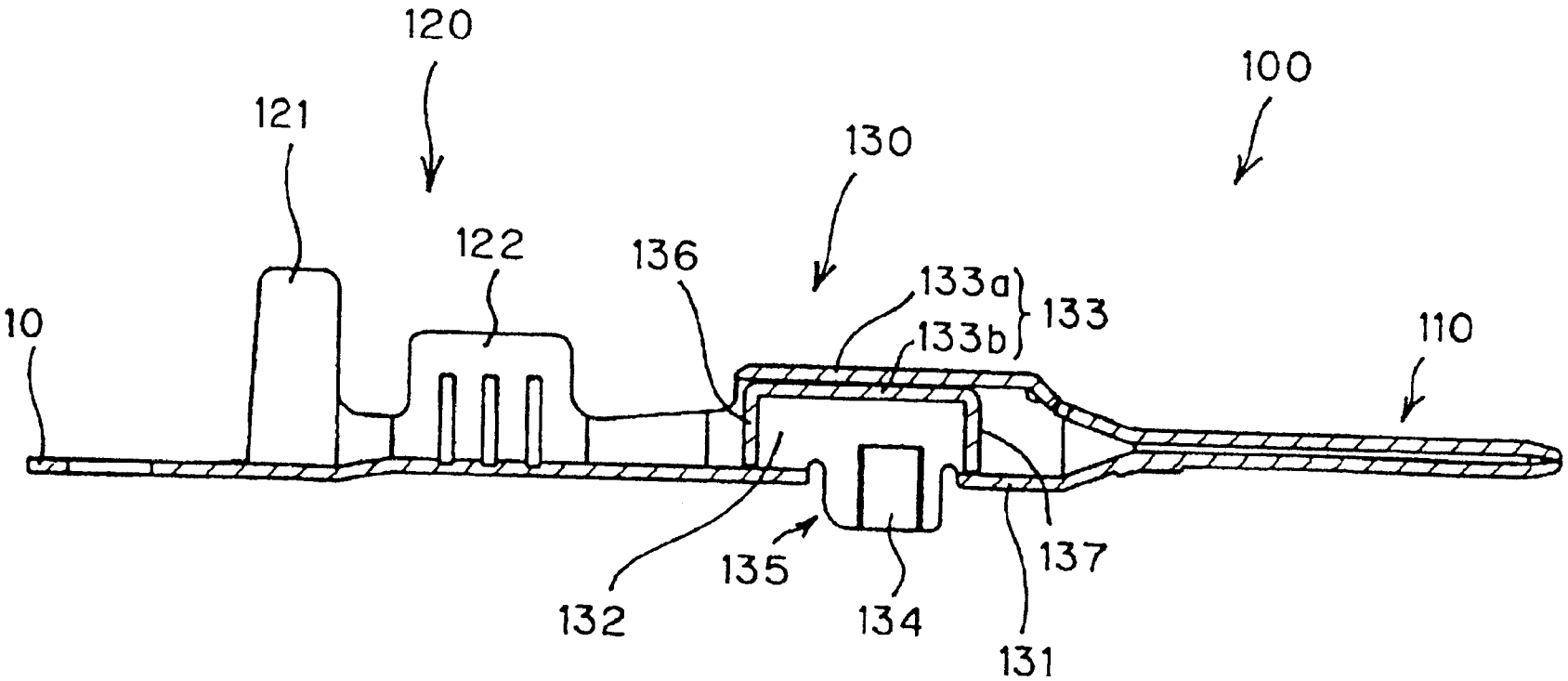
FIG. 5 is a sectional view along the line Z—Z in FIG. 1.
Figure 6:
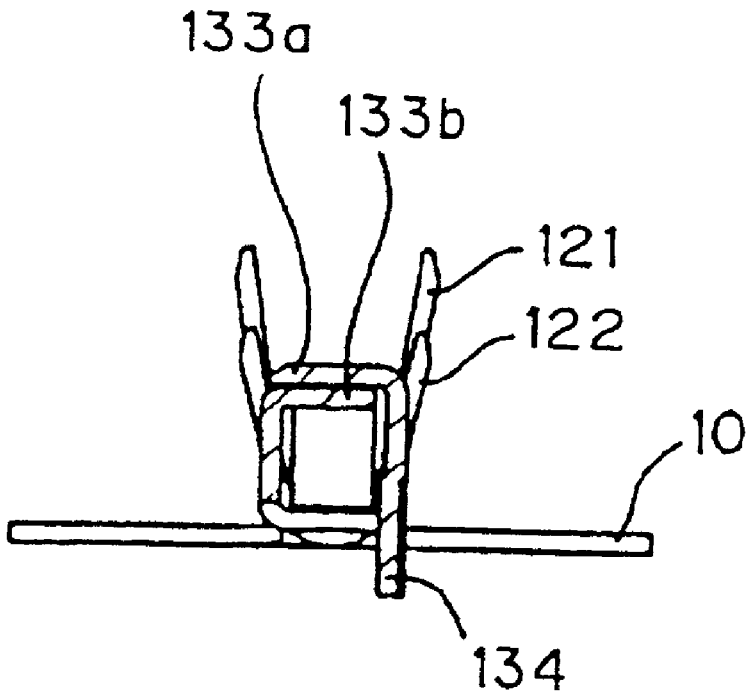
FIG. 6 is a sectional taken along the line Y—Y in FIG. 1.
Figure 7:
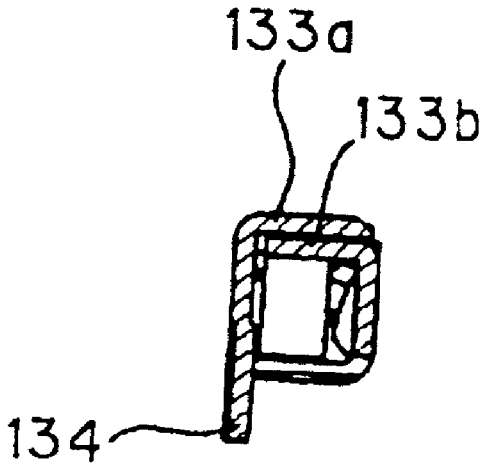
FIG. 7 is a sectional taken along the line YY—YY in FIG. 1.

As shown in FIG. 5, two stop walls 136 and 137 which extend from the inside top plate 133*b* are also disposed in the main body 130. Of these two walls 136 and 137, one wall 136 is formed in the vicinity of the rear end of the main body 130, while the other wall 137 is formed in the vicinity of the front end near the engaging hole 135. Here, the free ends of the walls 136 and 137 are disposed in extremely close proximity to the bottom wall 131. The gap between the free ends of the walls 136 and 137 and the bottom wall 131 is preferably between 0 mm and 0.25 mm. The reason that the free ends of the walls in contact with the bottom wall 131 is that formation of the main body 130 is not easy if such contact is made. Such disposition of the free ends of the walls and the bottom wall 131 in close proximity to each other also serves to reinforce the strength of the main body 130 against external forces applied from the vertical direction and to facilitate forming of the contact 100. These two walls 136 and 137 serve to block insertion of a contact section 110 of another contact. Accordingly, mutual entanglement of the male contacts is prevented. Consequently, bending of the male contacts, which have tended to occur when such contact parts are separated in conventional devices, are naturally prevented.

What is claimed is:

1. A male contact having a termination section extending rearward from a main body and a contact portion extending forward from a main body, the contact comprising:

a bottom wall, a pair of side walls, and a top wall forming the main body, the top wall further comprising two plates which are superimposed over each other and front and back walls that extend downward from the top plates to block forward and rearward openings in the main body.

2. The male contact of claim 1 wherein the front and back walls extend from the top plate toward the bottom wall.

3. The male contact of claim 1 further comprising a stabilizer extending from at least one of the side walls.

4. The male contact of claim 1 wherein the termination section further comprises a wire termination section.

5. The male contact of claim 4 wherein the wire termination section further comprises an insulation barrel extending from the wire termination section.

* * * * *